US010471316B1

(12) United States Patent
Bartlett et al.

(10) Patent No.: US 10,471,316 B1
(45) Date of Patent: Nov. 12, 2019

(54) GOLF BALL EJECTION DEVICE

(71) Applicants: William Bartlett, Fleming Island, FL (US); Thomas Occhiogrosso, Fleming Island, FL (US)

(72) Inventors: William Bartlett, Fleming Island, FL (US); Thomas Occhiogrosso, Fleming Island, FL (US)

( * ) Notice: Subject to any disclaimer, the term of this patent is extended or adjusted under 35 U.S.C. 154(b) by 0 days.

(21) Appl. No.: 16/364,762

(22) Filed: Mar. 26, 2019

(51) Int. Cl.
*A63B 57/00* (2015.01)
*A63B 57/40* (2015.01)

(52) U.S. Cl.
CPC ..... *A63B 57/405* (2015.10)

(58) Field of Classification Search
CPC ... A63B 57/357; A63B 57/40; A63B 69/3676; A63B 67/02; A63B 63/00; A63B 63/007; A63B 69/36; A63B 47/02; A63B 57/405
USPC ..... 473/173–177, 179
See application file for complete search history.

(56) References Cited

U.S. PATENT DOCUMENTS 979,313 A * 12/1910 King
1,599,734 A * 9/1926 Wilson ..... A63B 57/40 473/177
3,180,644 A 4/1965 Winquist
3,310,026 A 3/1967 Baird
4,018,182 A 4/1977 Knaack
4,360,200 A 11/1982 English
5,018,730 A 5/1991 Iliuta
5,451,045 A * 9/1995 Garske ..... A63B 57/357 473/176
5,890,967 A 4/1999 Allen
6,409,609 B1 6/2002 Brezic
6,722,997 B2 * 4/2004 Gilmour ..... A63B 57/357 473/176
7,431,658 B2 * 10/2008 Priegel ..... A63B 57/357 473/175
8,025,584 B2 9/2011 Foley
8,147,346 B2 4/2012 Long
8,740,716 B1 6/2014 Mallonee
8,777,768 B2 7/2014 Schoppe et al.
9,662,554 B2 5/2017 Skurow et al.
2002/0198059 A1 * 12/2002 Gilmour ..... A63B 57/357 473/176
2003/0157989 A1 * 8/2003 Porter ..... A63B 57/357 473/173
2003/0228923 A1 * 12/2003 Joswick ..... G09F 23/00 473/175
2005/0272515 A1 12/2005 Hurley et al.
2009/0137331 A1 * 5/2009 Hansen ..... A63B 57/357 473/176
2012/0190468 A1 7/2012 Long

* cited by examiner

*Primary Examiner* — Nini F Legesse
(74) *Attorney, Agent, or Firm* — Lawrence J. Gibney, Jr.

(57) ABSTRACT

Golf regulations have recently changed so that the golf flagstick or flag no longer is required to be removed during play. It is important to be able to retrieve the ball, and this device, which is slightly smaller than the diameter of the golf club hole will be placed on the lower end of the golf flag stick. The device will be hidden from view when the flagstick is in the golf hole. The golfer retrieves the ball by pulling up on the flagstick until the ball rolls out of the cup. This device to retrieve the ball will prevent damage to the putting surface.

5 Claims, 6 Drawing Sheets

GOLF BALL EJECTION DEVICE

FIELD OF THE INVENTION

The invention of this device will assist the golfer in quickly ejecting the golf ball from the hole. The object of golf is to sink the ball in a hole on a putting green in a predetermined location. A golf stick (or "flag" or "flagstick") is placed in the hole and when the ball drops in the hole it is sometimes difficult to retrieve the ball without damaging the putting surface, particularly if the stick is still in the hole. It is very important for the greens (putting surface) of any golf course to remain in the best possible condition. Excessive wear and tear on the greens, particularly around the hole or cup may occur as golfers attempt to retrieve the ball from the hole.

PRIOR ART

There are many other prior art references to golfing devices that describe flagsticks or related devices. A representative example of this is English U.S. Pat. No. 4,360,200 which is a golf flag stick holder. This is a holder as opposed to a ball retriever however, it does encompass some of the same concepts as the current application but is substantially different than the current application.

Another example of a golf related device can be found a golf ball ejecting and this can be found at Iliuatau U.S. Pat. No. 5,018,730 which is an ejection apparatus, which is spring loaded. This is different than the current application although it does demonstrate that there are many particular methods to get a golf ball out of a hole. Another representative example that teaches a ball ejection apparatus using a solenoid system can be found at Allen U.S. Pat. No. 5,890,967. Again, this is substantially different than the current application.

Another representative example can be found at Mallonee which is a golf ball ejection device which is integrated into a golf flag pin. The slidable component on the flag will raise a dome-shaped ejector component positioned within the hole cup thereby ejecting golf balls but also at the same time preventing the golf ball from falling back into the hole. The current device does not use the component on the flag stick nor is any manipulation required of the actual flagstick other than lifting it until the ball is ejected.

BRIEF SUMMARY OF THE INVENTION

In the game of golf, the object is to place the ball in the hole or cup in as few strokes as possible. In order to achieve that goal it is important that the playing surfaces, particularly the putting surface or "greens" are properly maintained so that the ball travels in the desired direction towards the hole.

A flagstick is placed in each hole and serves as a target for the golfer as he or she plays. The flagstick is upright in the hole during play until it is removed as the golfer putts. It is important to maintain the area around the hole to prevent errant putts.

Damage to the area of the green around the hole can occur when the golfer presses against the surface of the green as he or she tries to retrieve his ball and presses against the surface of the green. It can also be damaged if the ferrule, which is located on the bottom of the golf flagstick strikes the surface of the green around the hole.

This device is placed on the bottom of the flagstick above the ferrule and is normally not visible during play. After the golfer makes his putt with the flagstick still in the golf hole, the golfer will simply raise the flagstick a certain distance and the ball will be ejected from the hole. With this device the golfer will not need to remove the flagstick in order to retrieve the golf ball nor will he need to bend down to retrieve the ball from the hole and this will eliminate all chances of the golfer damaging the area around the green.

Two embodiments are described in this application. The different embodiments are required because of the different diameter flagsticks that are in use. The diameter of the top portion of the golf flagstick may differ between golf flagsticks and the differences dictate the two embodiment; the bottom portion of the flagstick must be a certain diameter and this device will fit snugly around the bottom portion of the flagstick.

The first embodiment is inserted over the bottom portion of the flagstick by opening the device while the second embodiment is inserted when the device is slid down the flagstick. In either embodiment the device will rest above the ferrule and below the surface of the hole during normal golf play.

A ferrule is inserted into the golf cup to insure that the flagstick remains in a vertical position during the game of play.

Due to a recent change in the regulations, it is no longer necessary to remove the stick from the hole during the course of play and this device will eject the ball from the hole while preventing damage to the putting surface.

NUMBERING REFERENCES

1—Golf Hole
2—Flag Stick
5—Device
10—Drain holes
25—Circular piece
26—Cavities
30—Bushing
32—Slit in bushing
35—Hole in circular piece
40—Slit in circular piece

DETAILED DESCRIPTION OF THE EMBODIMENTS

Golf flagsticks come in different shapes and sizes. During the game of golf the flag stick remains in the hole and is removed when the player is putting on the green. These flagsticks can be plain or ornate and may have different diameters, depending on the course and the specific tastes of the golf course owner.

The flagstick is placed in the hole and it stands upright during normal play. At one end of the flagstick is the flag, which serves as a target for the golfer during play. At the other end of the flagstick is a ferrule (not depicted), which is inserted into an opening in the golf cup hole to ensure that the flagstick is in the proper position during play. The golf cup hole is a predetermined depth and width and can be moved on the green depending on the desires of the golf course owner. The top lip of the golf cup is located slightly below the surface of the ground.

Golfing regulations dictate the overall length of the golf flagstick and the diameter of the lower end of the flagstick. By regulation, the bottom portion of the golf flagstick must be a certain diameter.

A primary concern for the golf course owner is to maintain the golf course in a certain condition to maximize the enjoyment of the golfers. This is particularly true on the putting green and especially around the golf hole 1. Damage around the area of the hole can lead to errant putts. Damage around the perimeter of the golf hole 1 can occur by golfers pressing on the green surface when they are retrieving the ball from the hole or the ferrule on the bottom of the flag bumping the surface around the golf cup as the flagstick is lifted out of the hole.

A circular piece 25 will permit the golfer to retrieve his ball from the hole without pressing on the surface of the green or removing the flag stick 2.

The circular piece 25 is placed on the bottom portion of the flagstick and placed within the golf cup hole. When the golfer wants to retrieve his ball, he or she simply lifts the flagstick until the ball is ejected from the hole without removing the flagstick from the hole or pressing on the surface of the green around the area of the hole. In this manner the golfer does not need to press the surface around the golf hole and does not need to remove the flagstick from the hole.

Figure 1:
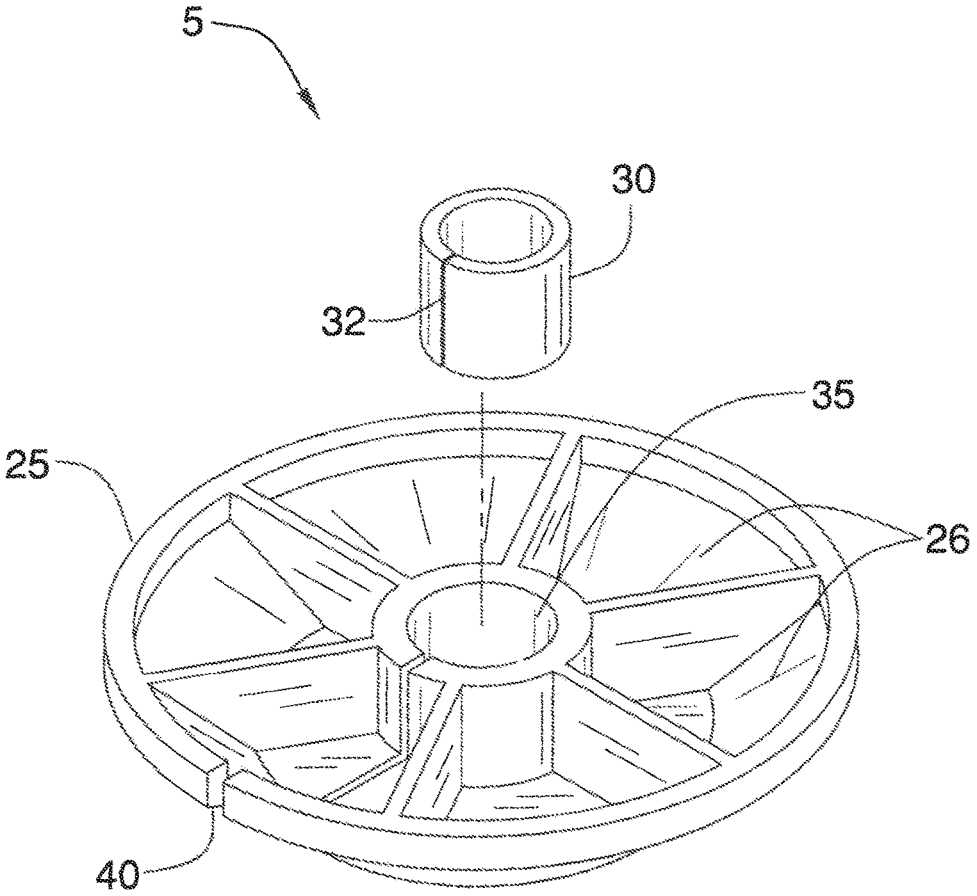
FIG. 1 is a front isometric view of the first embodiment.
Figure 2:
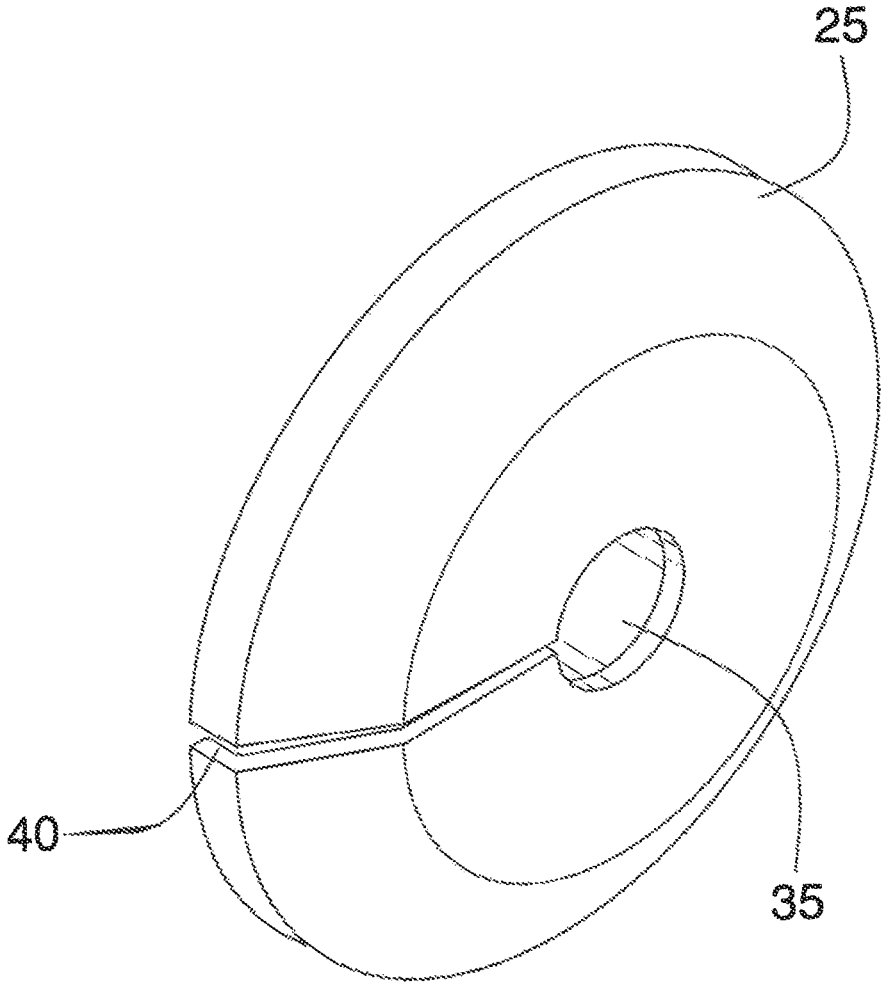
FIG. 2 is a top view of the first embodiment.
Figure 4:
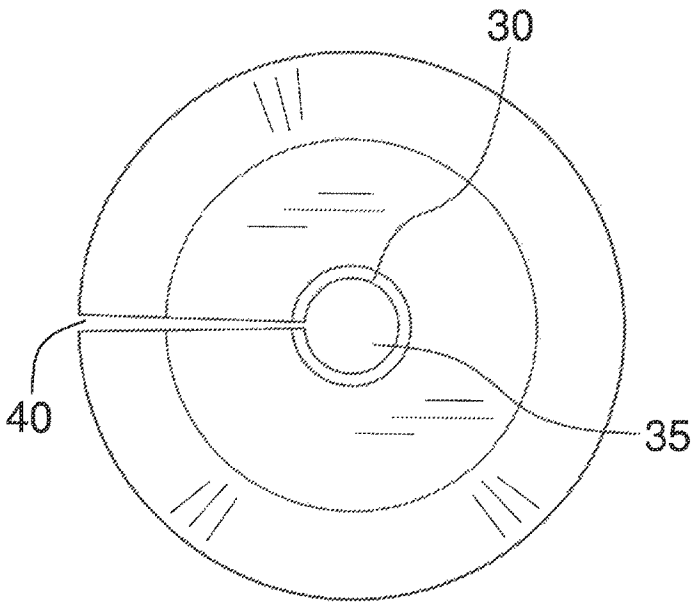
FIG. 4 is a cross-sectional view of the first embodiment
Figure 3:
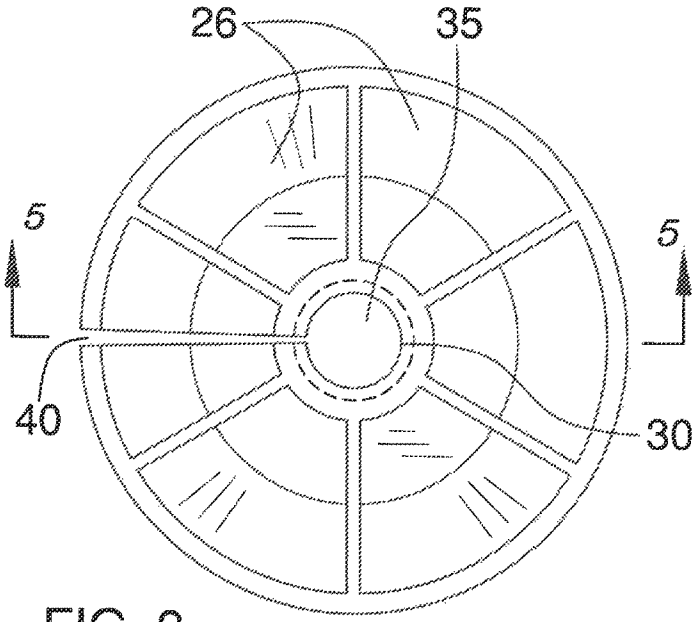
FIG. 3 is a bottom view of the first embodiment.
Figure 5:
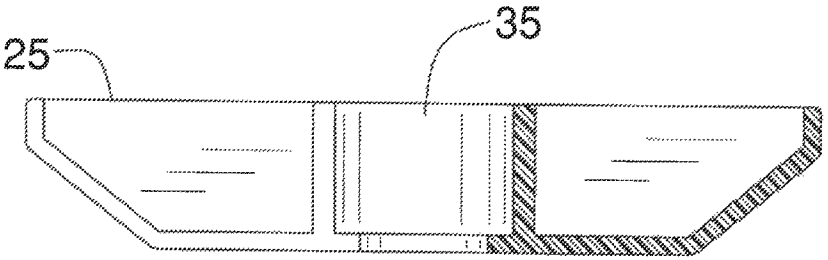
FIG. 5 is an in-use of the first embodiment
Figure 6:
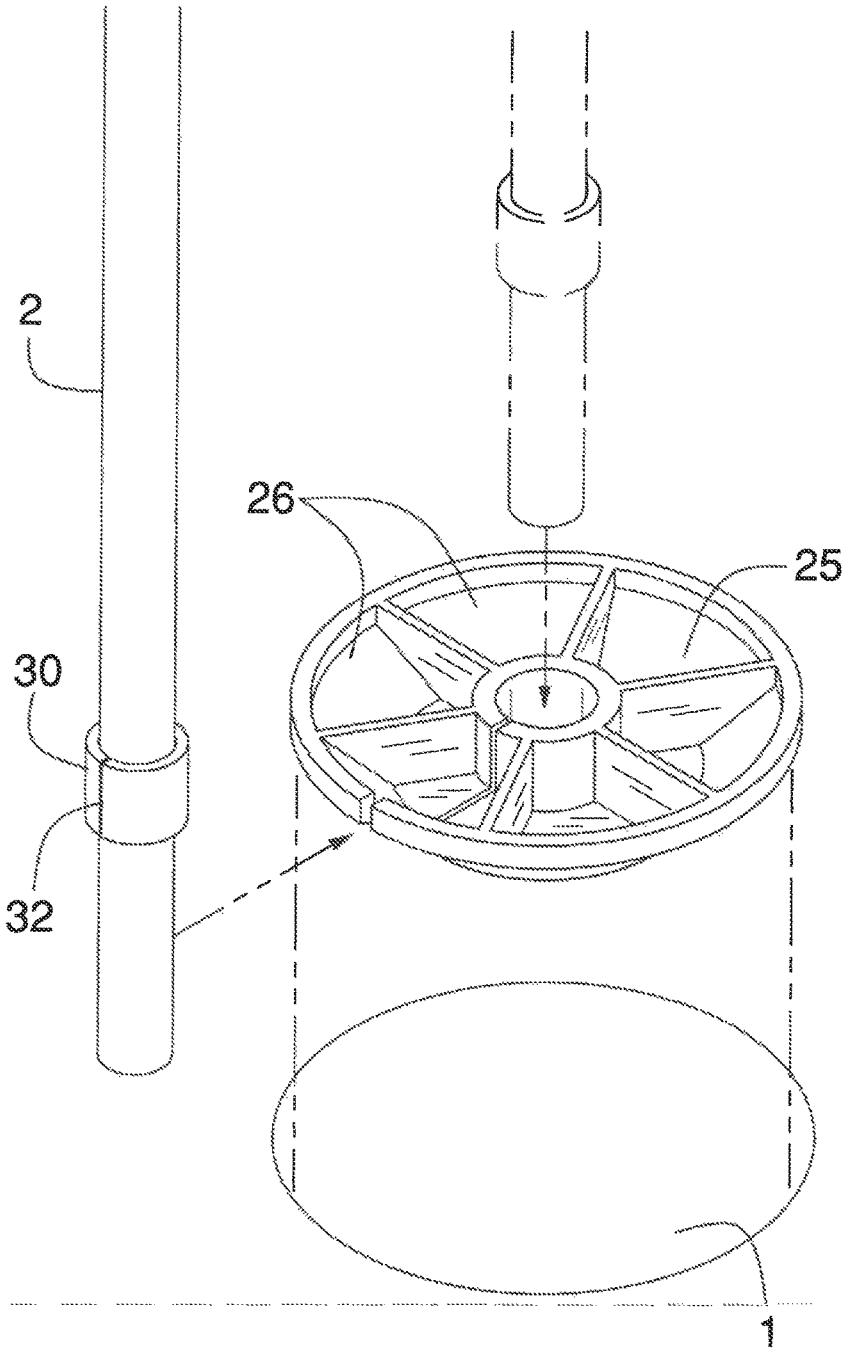
FIG. 6 is an in use view of the first embodiment

FIG. 1 depicts a series of cavities 26 in which the ball will rest when the flagstick is moved upwards. The circular piece 25 may also have a beveled surface (not depicted) on the top surface to allow the ball to roll away from the hole when the flagstick is lifted.

In order to accommodate all situations two embodiments are discussed.

First Embodiment

The first embodiment is depicted in FIGS. 1-6. This embodiment is used when the device cannot be inserted onto the top portion of the golf flagstick because of the diameter of the upper portion of the golf flagstick.

The device 5 is comprised of the following: a circular piece 25 with an opening 35 in the middle and a bushing 30. The opening 35 is slightly larger than the diameter of the golf flagstick 2.

With this device, it is important to insert it on the bottom so that it may fit snugly within the bottom portion of the golf stick and then inserted into the golf hole. The circular piece will be slightly smaller than the diameter of the golf hole.

The bottom portion of the flagstick will be inserted through the opening 35 in the middle of the circular piece. In the first embodiment, a slit 40 is placed so that the sides of the circular piece can be opened slightly and then inserted around the bottom portion of the flagstick.

Additionally, a bushing 30 is placed around the bottom portion of the flagstick; a slit 32 is provided on the bushing so that it can be inserted onto the golf flagstick. The bushing 30 is inserted into the opening 35 to ensure that the circular piece stays in the proper alignment.

The material used must be resistant to all environments and also be pliable enough so that it can be easily fit on the bottom of the golf stick.

Second Embodiment

Figure 7:
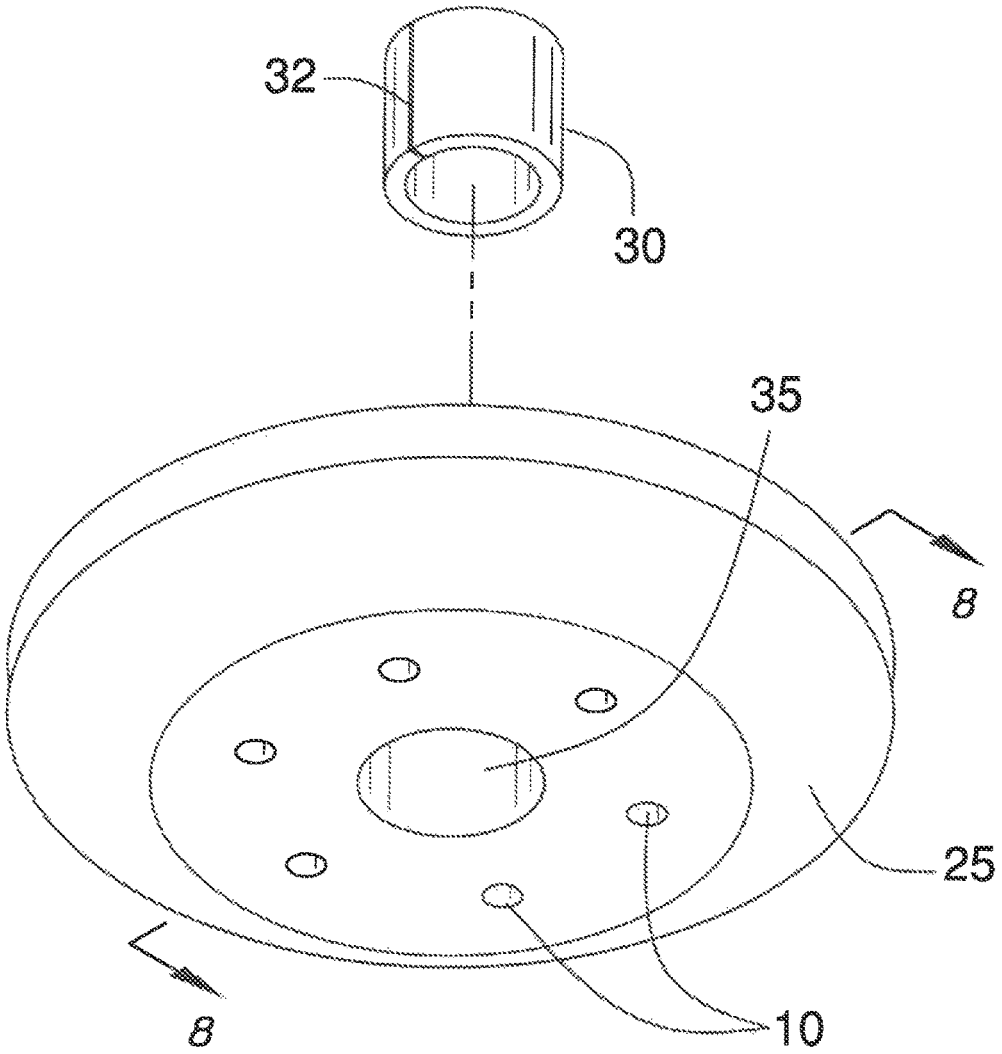
FIG. 7 is an isometric view of the second embodiment.
Figure 8:
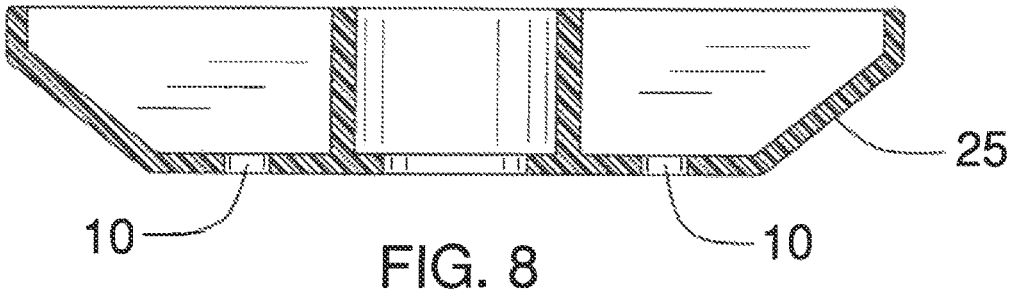
FIG. 8 is a cross-sectional view of the second embodiment
Figure 9:
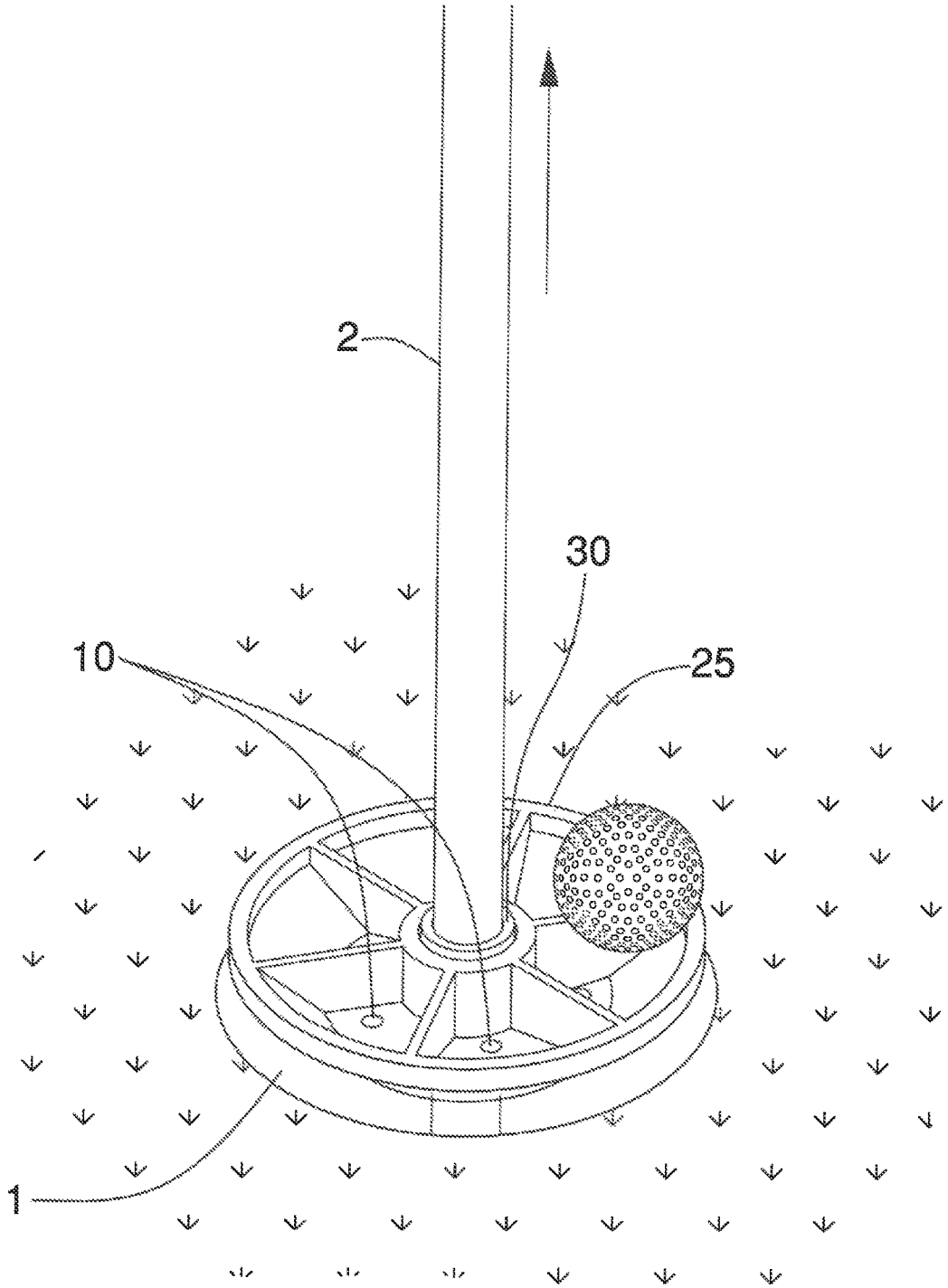
FIG. 9 is an in-use view of the second embodiment.

The second embodiment is depicted in FIGS. 7-9 and is for those instances where the device can be slid over the top of the flag all the way from the top of the flagstick to the bottom of the flagstick. There is no slit in the circular piece in this embodiment, but there are drainage holes in the circular material so that, if water should accumulate, it will naturally drain to the bottom of the hole and then drain into the ground. These drain holes 10 may be placed on the first embodiment as well.

Additionally, a bushing 35 is inserted over a portion of the golf flagstick and inserted into the opening of the circular material so that the device will snugly fit around the top and bottom portions of the golf flagstick.

While the embodiments of the invention have been disclosed, certain modifications may be made by those skilled in the art to modify the invention without departing from the spirit of the invention.

The inventors claim:

1. A golf ball ejection device, which is comprised of:
- a circular piece of material;
- wherein the diameter of the circular piece of material is less than the diameter of a golf hole;
- wherein the circular piece of material has a top surface and a bottom surface;
- wherein a hole is placed in the center of the circular piece of material;
- wherein the diameter of the hole in the center of circular piece of material is greater than the diameter of the flag stick;
- wherein the hole in the center of the circular piece of material is larger than the diameter of a golf flagstick;
- wherein the surface of the circular material is a predetermined thickness;
- a slit in the circular piece of material;
- wherein the slit extends from the hole in the center of the piece of circular material to the edge;
- a bushing;
- wherein the bushing is placed over the lower portion of the golf flagstick;
- wherein a slit is provided on the side of the bushing;
- wherein the slit in the bushing extends the length of the bushing;
- wherein the bushing is inserted in the hole of the circular piece of material;
- wherein a plurality of drain holes are placed on the top surface of the circular piece of material.

2. The device as described in claim 1 wherein the top surface of the circular piece is comprised of a series of cavities.

3. The device as described in claim 1 wherein the top surface of the circular piece is beveled.

4. A golf ball ejection device, which is comprised of:
- a circular piece of material;
- wherein the diameter of the circular piece of material is less than the diameter of a golf hole;
- wherein the circular piece of material has a top surface and a bottom surface;
- wherein a hole is placed in the center of the circular piece of material;
- wherein the diameter of the hole in the center of circular piece of material is greater than the diameter of the flag stick;
- wherein the hole in the center of the circular piece of material is larger than the diameter of a golf flagstick;

wherein the surface of the circular material is a predetermined thickness;

a slit in the circular piece of material;

wherein the slit extends from the hole in the center of the piece of circular material to the edge a bushing;

wherein the bushing is placed over the lower portion of the golf flagstick;

wherein a slit is provided on the side of the bushing;

wherein the slit in the bushing extends the length of the bushing;

wherein the bushing is inserted in the hole of the circular piece of material;

wherein a plurality of drain holes are placed on the top surface of the circular piece of material.

5. The device as described in claim 4 wherein the surface of the circular piece is comprised of a series of cavities.

* * * * *